US006851834B2

(12) United States Patent
Leysath

(10) Patent No.: US 6,851,834 B2
(45) Date of Patent: Feb. 8, 2005

(54) LIGHT EMITTING DIODE LAMP HAVING PARABOLIC REFLECTOR AND DIFFUSER

(76) Inventor: Joseph A. Leysath, 12204 NE. 64th, Kirkland, WA (US) 98033

( * ) Notice: Subject to any disclaimer, the term of this patent is extended or adjusted under 35 U.S.C. 154(b) by 31 days.

(21) Appl. No.: 10/327,523

(22) Filed: Dec. 20, 2002

(65) Prior Publication Data

US 2003/0117798 A1 Jun. 26, 2003

Related U.S. Application Data

(60) Provisional application No. 60/343,506, filed on Dec. 21, 2001.

(51) Int. Cl.[7] ..... F21V 7/06

(52) U.S. Cl. ..... 362/303; 362/302; 362/311; 362/240

(58) Field of Search ..... 362/800, 227, 362/234, 235, 236, 237, 240, 241, 247, 255, 257, 296, 307, 310, 311, 3, 11, 16, 217, 219, 238, 304, 305, 242, 243, 248, 246, 297, 298, 302, 303; 313/106, 107, 483, 498, 499, 500, 110, 113, 116, 117

(56) References Cited

U.S. PATENT DOCUMENTS

| | | | | | |
|---|---|---|---|---|---|
| 3,518,418 | A | * | 6/1970 | Dubois | 313/499 |
| 3,754,135 | A | * | 8/1973 | Hulbert, Jr. | 362/303 |
| 3,774,021 | A | * | 11/1973 | Johnson | 313/499 |
| 3,821,590 | A | * | 6/1974 | Kosman et al. | 313/499 |
| 4,211,955 | A | * | 7/1980 | Ray | 313/500 |
| 4,467,193 | A | * | 8/1984 | Carroll | 313/500 |
| 4,587,601 | A | * | 5/1986 | Collins | 362/303 |
| 4,654,758 | A | * | 3/1987 | Szekacs | 362/302 |
| 4,935,665 | A | * | 6/1990 | Murata | 313/500 |
| 5,084,804 | A | * | 1/1992 | Schairer | 362/459 |
| 5,160,200 | A | * | 11/1992 | Cheselske | 362/249 |
| 5,278,731 | A | * | 1/1994 | Davenport et al. | 362/551 |
| 5,463,280 | A | * | 10/1995 | Johnson | 315/187 |
| 5,655,830 | A | * | 8/1997 | Ruskouski | 362/240 |
| 5,688,042 | A | * | 11/1997 | Madadi et al. | 362/240 |
| 5,894,195 | A | * | 4/1999 | McDermott | 362/311 |
| 6,158,882 | A | * | 12/2000 | Bischoff, Jr. | 362/488 |
| 6,328,456 | B1 | * | 12/2001 | Mize | 362/311 |
| 6,558,032 | B2 | * | 5/2003 | Kondo et al. | 362/516 |
| 6,641,284 | B2 | * | 11/2003 | Stopa et al. | 362/240 |
| 6,641,293 | B2 | * | 11/2003 | Kumar et al. | 362/539 |
| 2003/0156416 | A1 | | 8/2003 | Stopa et al. | 362/294 |

* cited by examiner

*Primary Examiner*—Thomas M. Sember
*Assistant Examiner*—Ismael Negron
(74) *Attorney, Agent, or Firm*—Seed IP Law Group PLLC

(57) ABSTRACT

A light fixture consists of one or more light emitting diode (LED) packaging systems within a housing. Each LED packaging system includes one or more LED light sources that simultaneously shines onto opposing reflecting surfaces, then shines forward through encapsulation material. The housing consists of a cluster of prewired sockets with an outer reflective surface. Electrical wiring runs from the rear of the first socket and then to an adjacent socket in a daisy chain fashion. Each socket includes connectors configured to provide each LED packaging system with a source of electricity. The housing has diffusers that adjust the light to an evenly distributed appearance.

18 Claims, 7 Drawing Sheets

LIGHT EMITTING DIODE LAMP HAVING PARABOLIC REFLECTOR AND DIFFUSER

This application claims the benefit of Provisional application No. 60/343,506 filed on Dec. 21, 2001.

BACKGROUND OF THE INVENTION

1. Field of the Invention

The disclosed embodiments of the invention relate generally to lighting fixtures used for illumination purposes, and more particularly, to lighting fixtures used in buildings for the purpose of general illumination and accent illumination.

2. Description of the Related Art

General illumination in buildings is primarily from lighting fixtures. These lighting fixtures use either fluorescent, incandescent or a HID lighting source.

When a lighting source lamp burns-out, it must be replaced. Typically, a fluorescent lamp will need to be replaced every 15,000 hours, an incandescent lamp every 2000 hours, and an HID lamp every 20,000 hours. Associated ballast replacement occurs about every five years. The cost to conduct such maintenance and replacement can be expensive as well as disruptive to the occupants.

Lighting fixtures also deteriorate over time. Fixtures, and particularly metal fixtures, can be scraped or bent during maintenance or when an object strikes the fixture. This deterioration over time reduces fixture performance and fixture aesthetics.

In addition to maintenance, the cost of operating a fixture is tied directly to its energy use. Many municipalities also have restrictions on the amount of energy that can be allocated to general and accent illumination by lighting fixtures.

In present designs, LEDs are forward facing and the viewer can thus see the individual LED light sources. Typically these light sources appear as dots, which are not visually appealing and tend to not meet the criteria for illumination appearance desired by most users.

Thus it would be a great benefit to have a fixture that is virtually maintenance free, is resistant to deterioration of performance over its life span, has reduced power consumption, and has a softer appearance.

BRIEF SUMMARY OF THE INVENTION

An embodiment of the invention provides a lighting device having a reflector with a generally parabolic shape in cross section, a light emitting diode (LED) mounted on an inner surface of the reflector and at a center thereof, and a diffuser, suspended a distance from the center of the reflector and configured to block direct passage of light emitted from the diode. The diode may be one of a plurality of light emitting diodes mounted on the reflector and arranged in a regular configuration. The parabolic shape of the reflector may be formed by a plurality of planar facets co-positioned to provide a generally parabolic shape.

According to an embodiment of the invention, the reflector is circular in plan view.

According to another embodiment, the reflector has an elongated shape, in plan view, wherein the plurality of diodes are distributed along the length thereof, and wherein the diffuser is shaped and configured to block direct passage of light from each of the plurality of diodes.

According to an embodiment of the invention, the reflector, the diode or diodes, and the diffuser are encapsulated in a lighting unit formed from a transparent medium to form an LED packaging system.

According to one embodiment of the invention, a lighting fixture is provided, having a socket configured to receive an encapsulated lighting unit, and to provide a source of electricity thereto. The lighting fixture may include a plurality of sockets, each configured to receive a similar lighting unit.

One embodiment of the invention provides a method of manufacture of a device as provided by other embodiments of the invention, while another embodiment provides a method of operation of the device.

BRIEF DESCRIPTION OF THE SEVERAL VIEWS OF THE DRAWING(S)

Embodiments of the invention will now be described with reference to the accompanying drawings, wherein.

DETAILED DESCRIPTION OF THE INVENTION

Figure 2:
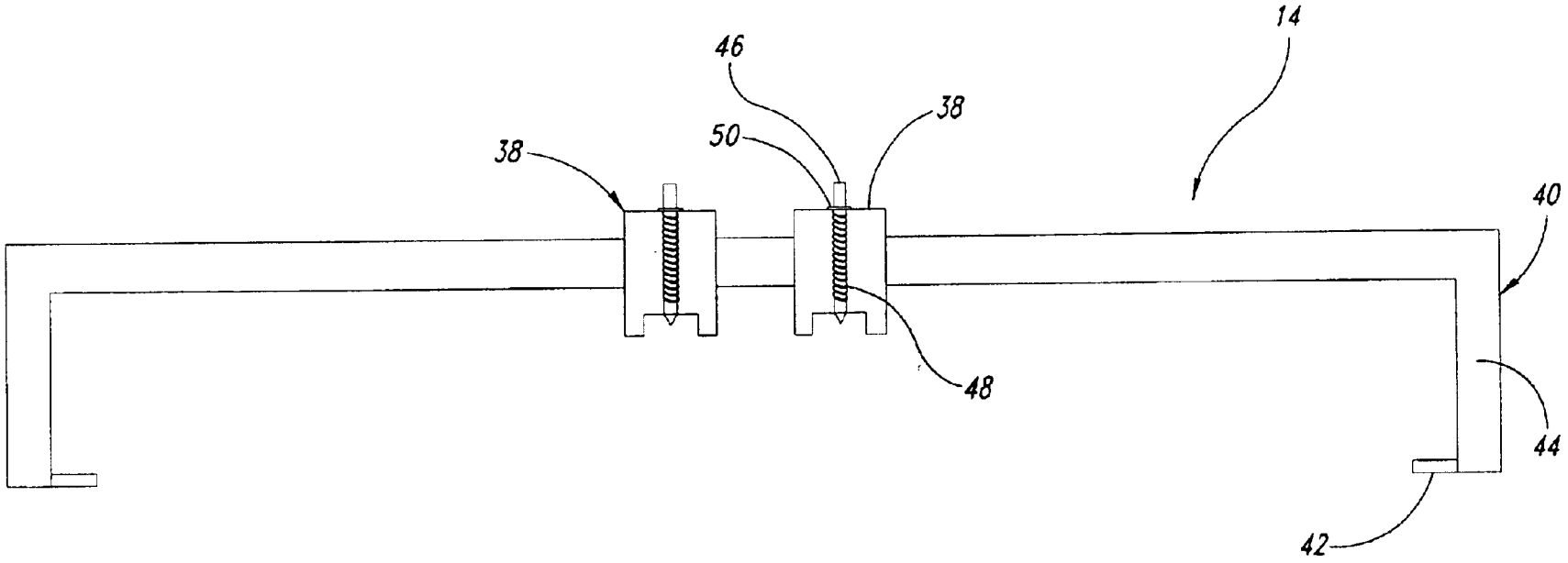
FIG. 2 is an end view of an LED socket.
Figure 3:
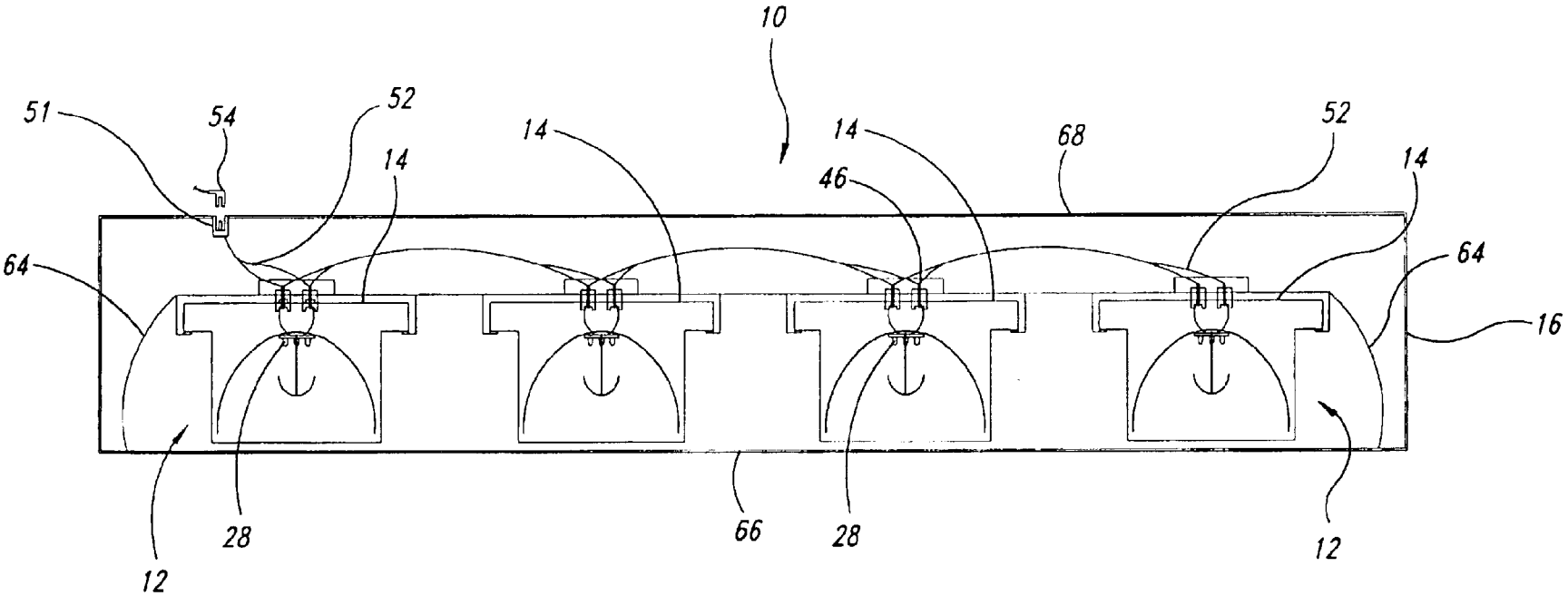
FIG. 3 is an elevation section schematic of the housing unit with the sockets and a typical LED packaging system assembled.

An LED light fixture 10 is shown in FIG. 3 that includes multiple LED packaging systems 12 (shown more clearly in FIG. 1) resting within multiple sockets 14 (shown in detail in FIG. 2) that are all enclosed within a housing 16.

Figure 1:
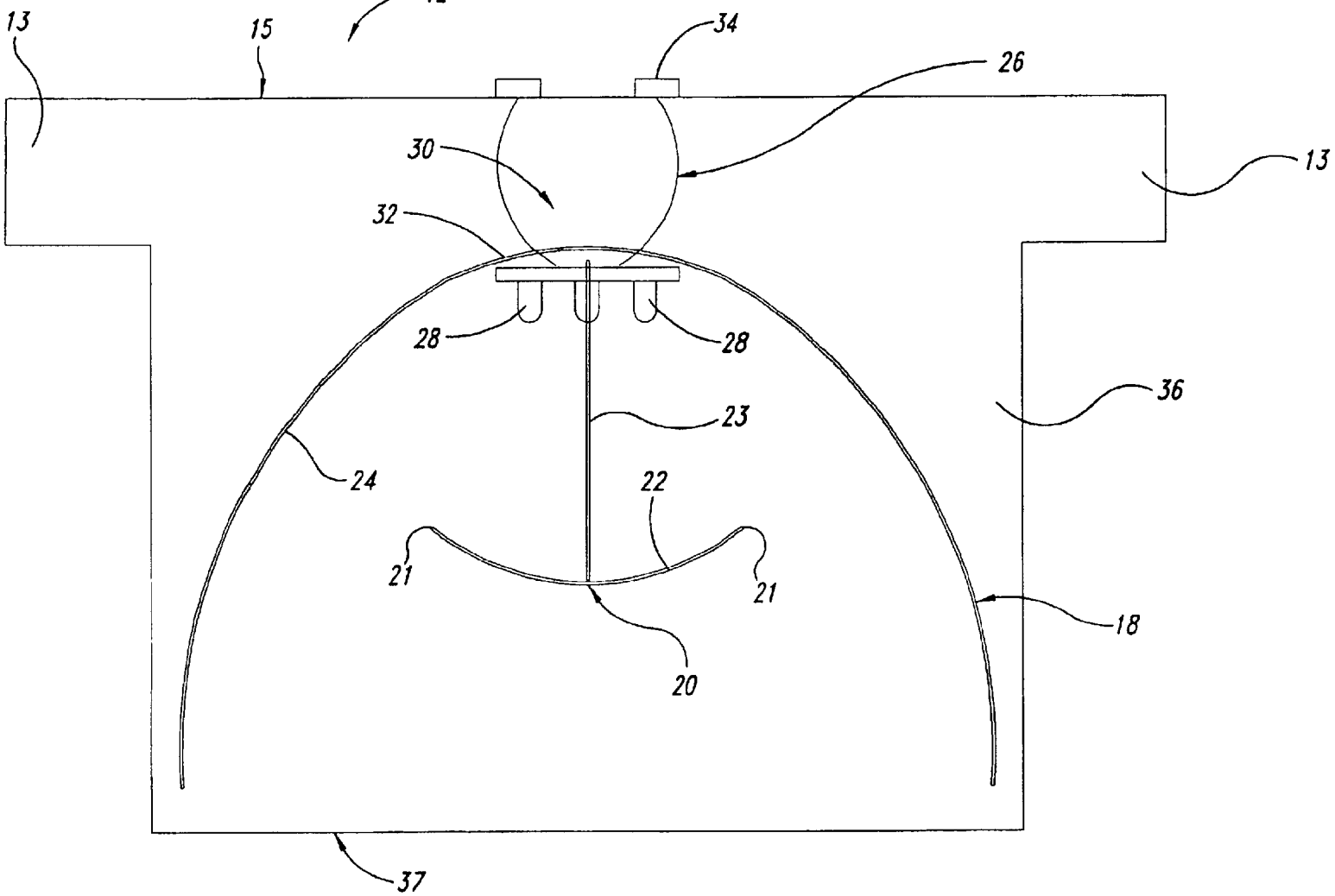
FIG. 1 is an end view of the LED packaging system formed in accordance with the present invention.

As shown in FIG. 1, the LED packaging system 12 consists of a parabolic-shaped reflector 18 that is curved and has a cluster of LEDs 28 mounted within the reflector 18 in the center of the parabola. At a focal point of the reflector 18 is a diffuser 20 configured to have a curved shape with an inner, concave, face 22 facing an inner, concave, face 24 of the reflector 18. The diffuser 20 is shaped and configured to prevent light from the LED's from exiting the reflector 18 without reflecting from at least one surface of the reflector 18. Outer rims 21 of the diffuser 20 extend to a point that light from the LED's passing the rims 21 must strike the face 24 of the reflector 18. The inner face 22 of the diffuser 20 may be polished to reflect light back to the parabolic reflector 18, or it may be configured to diffuse light. For example the diffusion may be in the form of faceting or frosting of the inner face 22, or the inner face 22 may have a non-reflective coating, such as flat black, for example, to absorb light striking thereon. The diffuser 20 is fixed in place by supports 23 in a conventional manner. Wiring 26 from the LED cluster 28 is routed via a hole 30 through the back 32 of the reflector 18 to electrical terminals 34.

Figure 4:
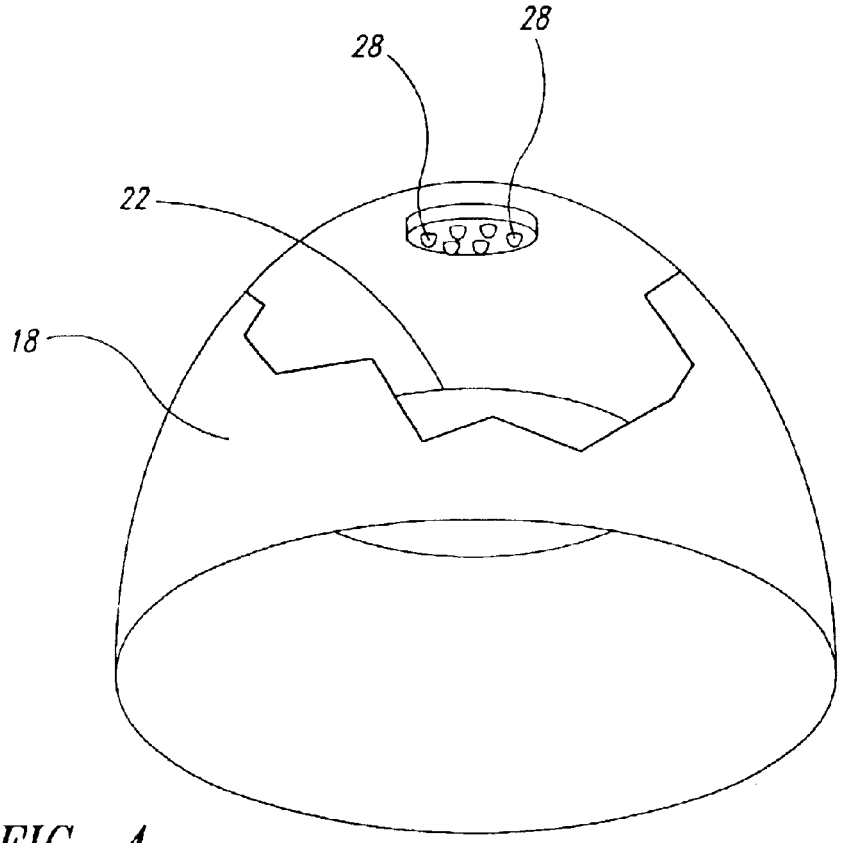
FIG. 4 is an isometric view of an embodiment of the invention.
Figure 5:
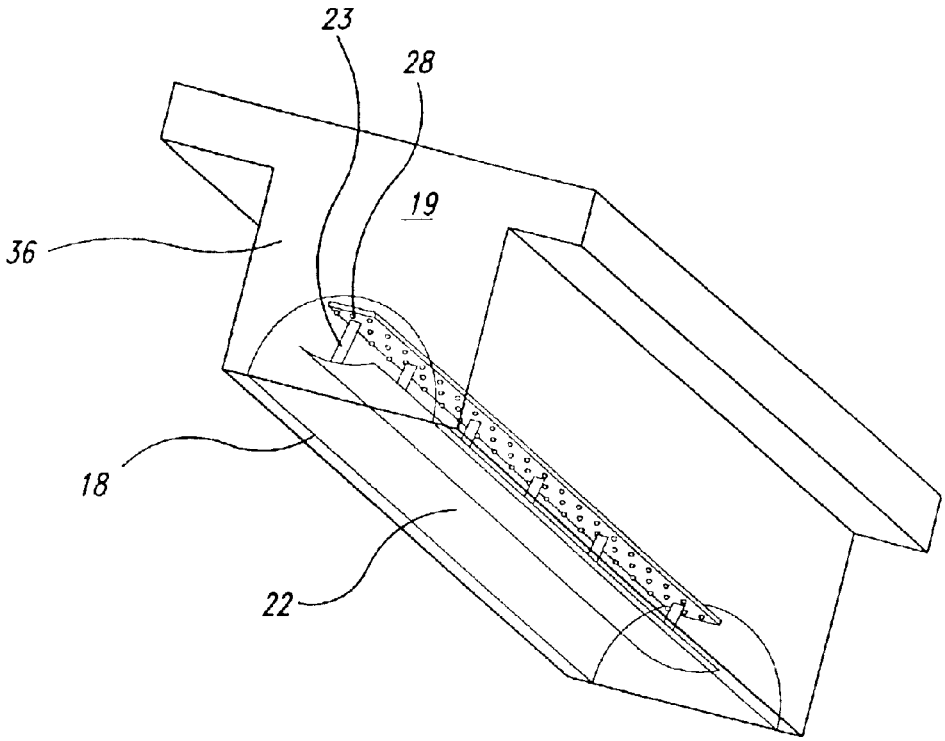
FIG. 5 is an isometric view of an alternative embodiment of the invention.

According to one embodiment of the invention, the reflector 18 is round in plan view as shown in FIG. 4. According to another embodiment, the reflector is elongated, as shown in FIG. 5.

The entire assembly is encapsulated with a transparent encapsulate 36, such as transparent polymer, forming a single lighting unit or LED packaging system 12. The electrical terminals 34 are affixed to a back face 15 of the encapsulate 36.

Light from the LED cluster 28 simultaneously shines forward and backward onto the reflector 18 and diffuser 20, then propagates forward through the front face 37 of the encapsulate 36 with a softened appearance.

Figure 6A:
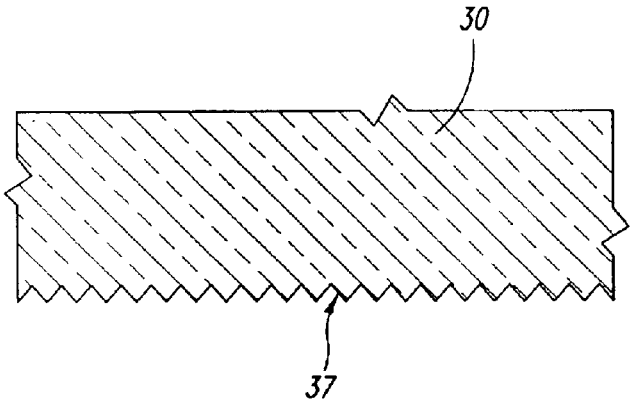
FIGS. 6A–6D are cross sections of various diffusion treatments, according to the invention.
Figure 6B:
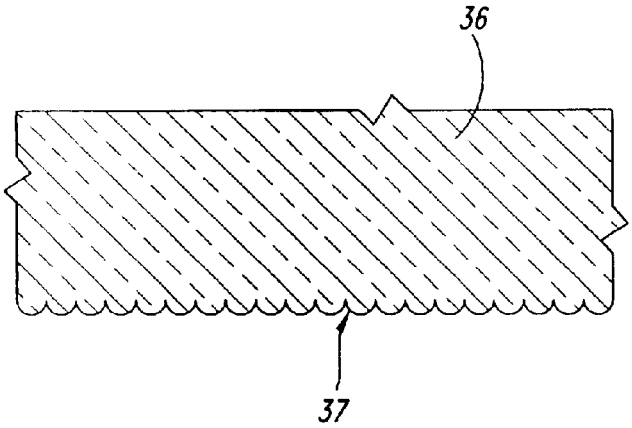
Figure 6C:
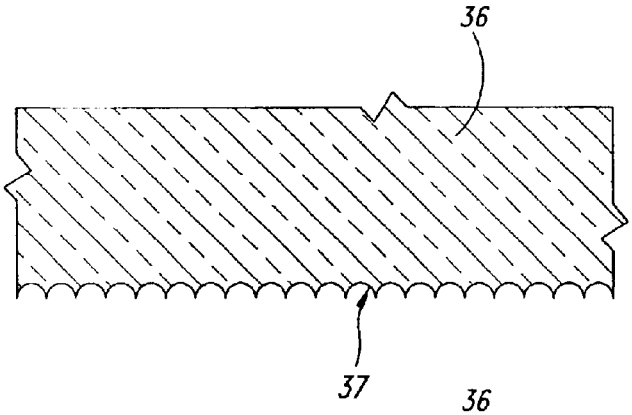
Figure 6D:
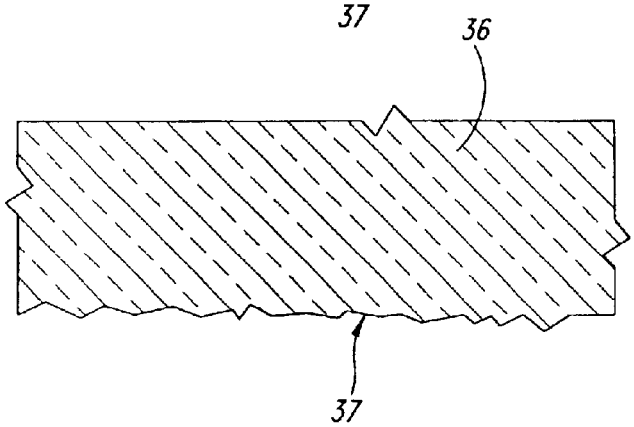

The front face 37 of the encapsulate 36 may have a surface configured to further diffuse light as it passes therethrough. For example, FIGS. 6A–6D illustrate various possible surface treatments. FIG. 6A illustrates a faceted surface, FIG. 6B illustrates a pebbled surface, FIG. 6C illustrates a dimpled surface, and FIG. 6D illustrates a randomly variegated surface. Other types of surface treatments will be obvious to one of ordinary skill in the art, and are within the scope of the invention.

An end face 19 of the encapsulate 36 may be opaque to prevent light from the LED's 28 from passing, undiffused, from the system 12. An inner surface of the end face 19 may be non-reflective, or have a reflective and diffusive treatment similar to those described with reference to the diffuser 20. Alternatively, the end face may be transparent to permit visual inspection of the system 12. In such a case, external means may be employed to block undiffused light from escaping the device.

FIGS. 1 and 5 show the LED packaging system 12 having a pair of flanges 13 adjacent to a back face 15 and configured to engage locking tabs 42 of a socket 14 (shown in FIG. 2).

Figure 7:
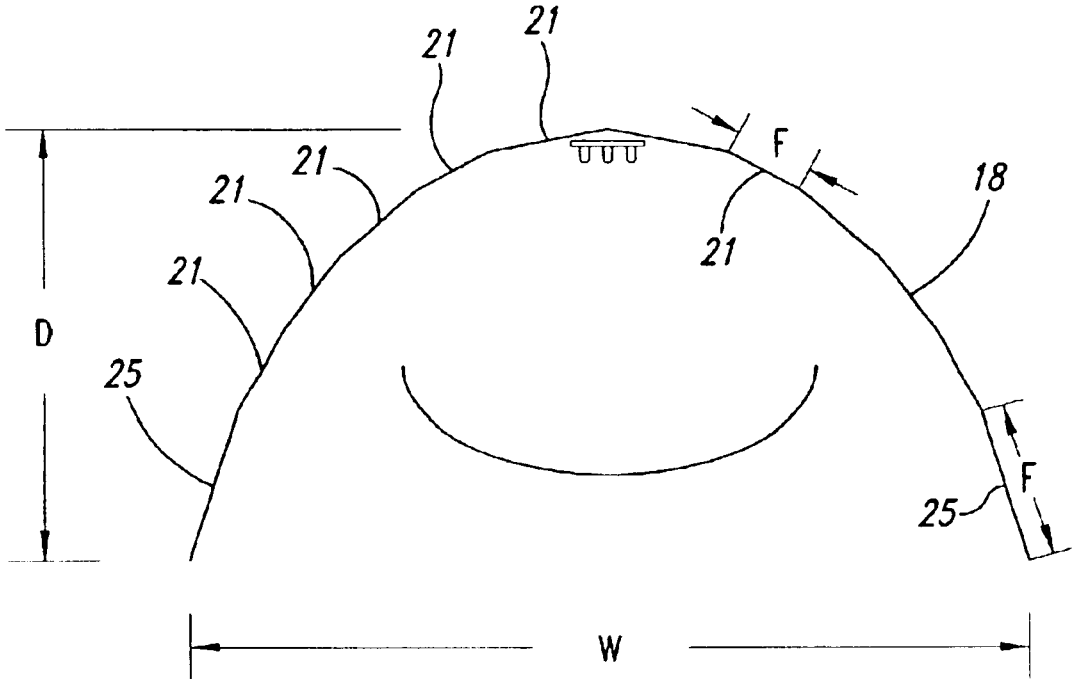
FIGS. 7 and 8 illustrate alternate embodiments of the invention;.

FIG. 7 illustrates an alternative embodiment of the reflector 18, in which the parabolic shape is formed by a series of planar sections or inner facets 21 and outer facets 25. According to one embodiment the inner facets 21 have a width F that is equal, about ⅜", while the outer facets 25 have a width of 1¼". Alternatively, the facets 21, 25 may have other dimensions or may vary in size. The width W of the reflector 18 may be 5½" and the depth D may be 2½". According to one embodiment, the diffuser 20 is 2½" wide by ¾" deep, and is 1" from the LED's.

Figure 8:
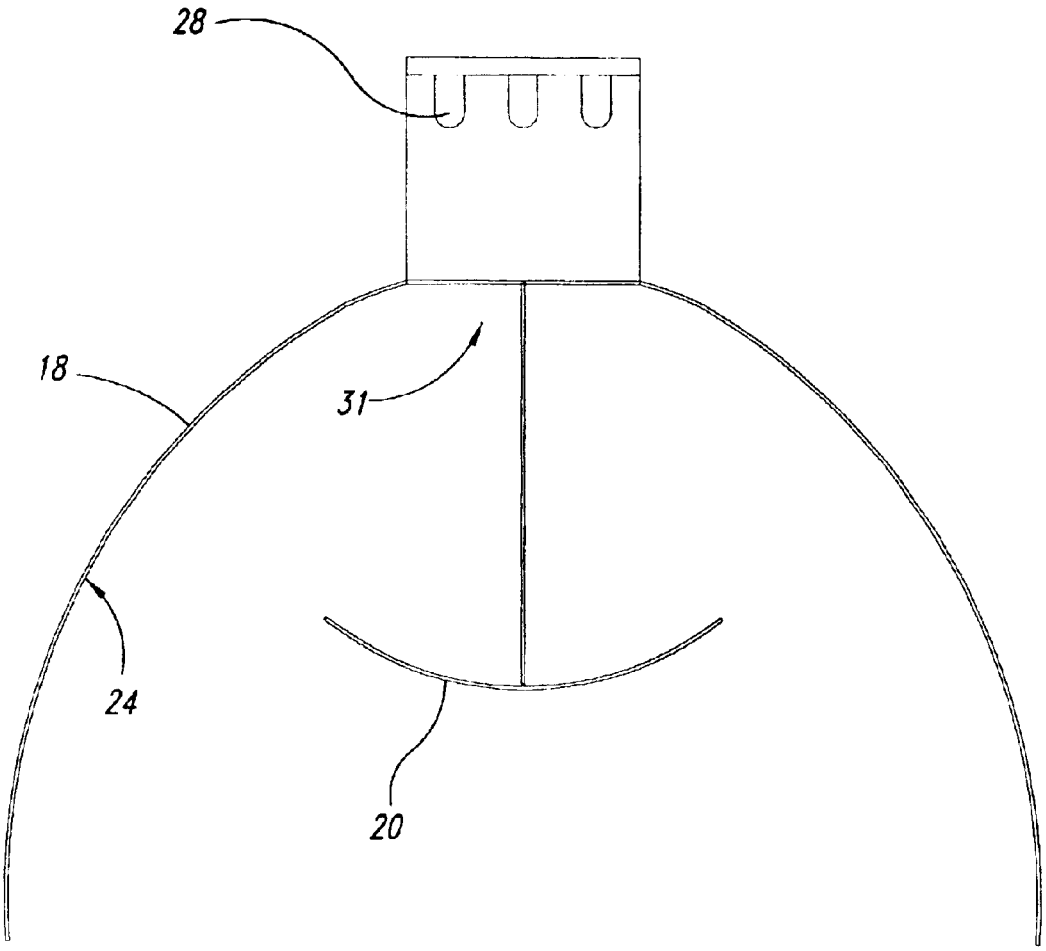

FIG. 8 illustrates an alternative embodiment in which the LED's 28 are located in a recess 29 behind the parabolic reflector 18, such that light from the LED's 28 passes through an opening 31 in the reflector 18 to be reflected by the diffuser 20 and inner face 24 of the reflector 18.

Referring to FIG. 2, a socket 14 is shown therein to consist of two connector assemblies 38 mounted in a socket housing 40. Locking tabs 42 are shown that project inward from the side walls 44. The locking tabs 42 engage the flanges 13 (shown in FIG. 1) of the encapsulated LED light sources, in this case the LED packaging systems 12. The connector assembly 38 includes a terminal 46 inserted in a coil spring 48 that is secured in the connector assembly 38 via a lock washer 50. The purpose of the socket 14 is to hold the LED packaging systems 12 and to transfer electricity via the terminals 46 from an electricity source to the LED packaging system 12. In addition, the socket 14 allows the LED packaging system 12 to be easily replaced, if necessary.

Referring next to FIG. 3, the LED light fixture 10 is shown, consisting of multiple sockets 14 wired in a parallel daisy chain manner with wiring 52. The wiring 52 is connected to the terminals 46 with combination metallic plugs and a strain relief (not shown). The parallel daisy chain wiring 52 is connected to an electrical socket 51, which in turn is rigidly attached to the housing 16. The source of electricity is connected to the electrical socket 50 via an electrical plug 54. The housing 16 is an envelope that consists of a diffuser 66 mounted at the base 68. On both sides of the fixture 10 there is a reflective surface 64 to help direct light from the LED light sources 28 down and out of the LED light fixture 10.

In the event that the end faces 19 (shown in FIG. 5) of the individual systems 12 are not opaque, the light fixture 10 is provided with an end wall configured to block passage of undiffused light.

While the invention has been described in the context of a light fixture 10 having four aligned LED packaging systems 12, it is to be understood that a preferred embodiment of the invention will have a two-by-four arrangement of LED packaging systems 12. The packaging systems 12 can also be configured to be used as a single down light with one or more LED light sources encapsulated in the LED packaging system 12.

Advantages of the LED light fixture will be apparent to those skilled in the art. For example, while fluorescent lighting may be expected to outlast incandescent lighting by a factor of seven or eight, LED's typically outlast fluorescent lights by a factor of seven or more, and incandescents by a factor of fifty or more. Additionally, with the development of high output LED's, the lumens/watt ratio of LED's exceeds that of fluorescent lamps by a factor of between five and twenty five, and incandescent lamps by a factor of between fifteen and seventy five. Thus, not only do LED's conserve energy directly by using less power to produce an equal amount of light, they also conserve energy indirectly, inasmuch as a large part of the energy expenditure of modern offices is used to cool the air heated by lighting, not to mention the possible impact on conservation of natural resources. Additionally, because LED systems have a much longer service life, maintenance costs are also reduced.

By encapsulating the reflectors and the LED's in a transparent medium, the reflectors are protected from damage due to handling or other contact, which in turn makes possible the use of very thin or fragile materials in the manufacturing process, since the reflectors will not need to withstand any abuse. This reduces the material cost of the manufacturing. Additionally, the reflector diffuser and LED's can be optimally aligned prior to encapsulation, without fear that the alignment might be compromised by rough handling. Thus, the light output of the fixture can be maximized while ensuring that the harsh light of the LED's is properly buffered.

While a preferred embodiment of the invention has been illustrated and described, it is to be understood that other changes may be made without departing from the spirit and scope of the invention. For example, while a transparent polymer may be used as the encapsulate, other similar materials can be used or materials having similar properties. A transparent epoxy can also be used as the encapsulate. In addition, the main parabolic-shaped reflector 18, shown in cross-section in FIG. 3, may have an elongate shape with open ends. To prevent the escape of light from the open ends of the main reflective surface 18, the encapsulate adjacent the open ends can be coated with a reflective material that is readily commercially available.

All of the above U.S. patents, U.S. patent application publications, U.S. patent applications, foreign patents, foreign patent applications and non-patent publications referred to in this specification and/or listed in the Application Data Sheet, including but not limited to [insert list], are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A lighting device, comprising:

a reflector having a generally parabolic cross-sectional configuration;

a light emitting diode located a selected distance from an inner surface of the reflector and at a midpoint thereof; and a diffuser suspended a distance from the inner surface of the reflector and configured to prevent light emitted from the diode that has not reflected from the inner surface of the reflector from exiting from the device; and wherein the reflector, the diode, and the diffuser are encapsulated in a lighting unit formed from a transparent medium.

2. The device of claim 1 wherein the reflector is circular in plan view.

3. The device of claim 1 wherein the transparent medium is a polymer.

4. The device of claim 1 wherein the generally parabolic reflector comprises a plurality of planar facets.

5. The device of claim 1 wherein the diode is located on a side of the reflector away from the inner surface of the reflector, such that light emitted from the diode passes through an opening in the reflector to reflect from the diffuser and the inner surface of the reflector.

6. The device of claim 1 wherein the light emitting diode is one of a plurality of light emitting diodes arranged in a regular configuration relative to the center of the reflector.

7. The device of claim 6 reflector has an elongated shape, in plan view, the plurality of diodes are distributed along the length thereof, and the diffuser is shaped and configured to block direct passage of light from each of the plurality of diodes out of the reflector.

8. The device of claim 1 wherein a surface of the lighting unit opposite a concave face of the parabolic reflector has light diffusive properties.

9. The device of claim 8 wherein the light diffusive properties include texturing of the surface.

10. The device of claim 1 wherein a side of the lighting unit opposite a convex face of the reflector has a shape configured to mount into a socket.

11. The device of claim 10, further comprising a socket configured to removably receive the shaped side of the lighting unit.

12. The device of claim 11, further comprising a lighting fixture, and wherein the socket is one of a plurality of sockets, each configured to removably receive a lighting unit therein.

13. A method, comprising:

mounting a light emitting diode within a parabolic reflector;

mounting a diffuser between the diode and a mouth of the reflector, the diffuser shaped and positioned to prevent light from passing directly out of the mouth of the reflector from the diode; and encapsulating the diode, reflector, and diffuser within a transparent encapsulate.

14. The method of claim 13, further comprising mounting additional diodes within the reflector.

15. A lighting device, comprising:

a reflector having a generally parabolic cross-sectional configuration;

a light emitting diode located a selected distance from an inner surface of the reflector and at a midpoint thereof, the reflector and the diode being encapsulated in a lighting unit formed from a transparent medium; and a diffuser suspended a distance from the inner surface of the reflector and configured to prevent light emitted from the diode that has not reflected from the inner surface of the reflector from exiting from the device.

16. The device of claim 15 wherein the diffuser is encapsulated with the diode and reflector in the transparent medium.

17. A method, comprising:

applying electricity across a light emitting diode positioned within a parabolic reflector to generate light from the diode;

reflecting the light from the diode against an inner surface of the reflector in a direction generally away from an open side of the reflector; and blocking light from the diode that has not reflected from the surface of the parabolic reflector.

18. A lighting device, comprising:

a reflector having a generally parabolic cross-sectional configuration;

a light emitting diode located a selected distance from an inner surface of the reflector at a midpoint thereof, and on a side of the reflector away from the inner surface of the reflector;

a diffuser suspended a distance from the inner surface of the reflector and configured to prevent light emitted from the diode that has not reflected from the inner surface of the reflector from exiting from the device; and an opening in the reflector positioned such that light emitted from the diode passes through the opening in the reflector to reflect from the diffuser and the inner surface of the reflector.

* * * * *